US011423854B2

(12) United States Patent
Shan

(10) Patent No.: US 11,423,854 B2
(45) Date of Patent: Aug. 23, 2022

(54) DRIVING METHOD AND SYSTEM OF DISPLAY PANEL, AND DISPLAY DEVICE

(71) Applicants: CHONGQING HKC OPTOELECTRONICS TECHNOLOGY CO., LTD., Chongqing (CN); HKC CORPORATION LIMITED, Shenzhen (CN)

(72) Inventor: Jianfeng Shan, Shenzhen (CN)

(73) Assignees: CHONGQING HKC OPTOELECTRONICS TECHNOLOGY CO., LTD., Chongqing (CN); HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/417,392

(22) PCT Filed: Mar. 9, 2020

(86) PCT No.: PCT/CN2020/078415
§ 371 (c)(1),
(2) Date: Jun. 23, 2021

(87) PCT Pub. No.: WO2020/207169
PCT Pub. Date: Oct. 15, 2020

(65) Prior Publication Data

US 2022/0076643 A1 Mar. 10, 2022

(30) Foreign Application Priority Data

Apr. 8, 2019 (CN) ..... 201910275101.2
Apr. 8, 2019 (CN) ..... 201910275213.8

(51) Int. Cl.
*G09G 3/36* (2006.01)
*G09G 3/20* (2006.01)

(52) U.S. Cl.
CPC ..... *G09G 3/3607* (2013.01); *G09G 3/2007* (2013.01); *G09G 2320/028* (2013.01);
(Continued)

(58) Field of Classification Search
None
See application file for complete search history.

(56) References Cited

U.S. PATENT DOCUMENTS 4,974,070 A * 11/1990 Hock ..... H04N 1/648 358/518
5,168,532 A * 12/1992 Seppi ..... H04N 5/32 348/217.1
(Continued)

FOREIGN PATENT DOCUMENTS

CN 101115211 A 1/2008
CN 109559693 A 4/2013
(Continued)

OTHER PUBLICATIONS

Chao Wang, the International Searching Authority written comments, dated Jun. 2020, CN.
(Continued)

*Primary Examiner* — Michael J Jansen, II

(57) ABSTRACT

The present application discloses a driving method and driving system of a display panel, and a display device. The driving method includes: converting the first color signal to obtain a first HSV (hue, saturation, value) spatial signal; obtaining a second HSV spatial signal; reducing the minimum value of the first brightness normalized signals according to the second HSV spatial signal to obtain second brightness normalized signals; converting the second bright-
(Continued)

ness normalized signals to obtain a second color signal; and driving the display panel using the second color signal.

19 Claims, 7 Drawing Sheets

(52) U.S. Cl.
CPC ..... *G09G 2320/0242* (2013.01); *G09G 2320/0276* (2013.01); *G09G 2340/06* (2013.01); *G09G 2360/16* (2013.01)

(56) References Cited

U.S. PATENT DOCUMENTS 5,278,640 A * 1/1994 Aizu ..... H04N 1/6019 358/527
5,363,219 A * 11/1994 Yoshida ..... H04N 1/41 358/1.9
5,450,217 A * 9/1995 Eschbach ..... H04N 1/6027 358/518
5,515,172 A * 5/1996 Shiau ..... H04N 1/465 358/521
6,577,775 B1 * 6/2003 Li ..... G06T 5/40 382/274
6,876,777 B2 * 4/2005 Liu ..... G06T 5/20 358/463
6,943,768 B2 * 9/2005 Cavanaugh ..... G02F 1/133382 345/204
7,414,673 B2 * 8/2008 Shyu ..... G09G 5/02 348/675
7,433,104 B2 * 10/2008 Cheo ..... H04N 1/6027 358/1.9
8,111,915 B2 * 2/2012 Cho ..... H04N 1/60 382/167
8,654,141 B2 * 2/2014 Zhang ..... G09G 5/02 345/589
8,791,953 B2 * 7/2014 Kwon ..... G09G 3/3233 345/589
8,837,828 B2 * 9/2014 Kang ..... G09G 5/02 382/167
8,861,850 B2 * 10/2014 Uslubas ..... H04N 1/6008 358/1.9
9,589,534 B2 * 3/2017 Wu ..... G09G 5/026
10,909,898 B2 * 2/2021 Kobayashi ..... H04N 9/30
11,127,370 B2 * 9/2021 Kobayashi ..... G09G 5/02
2003/0031376 A1 * 2/2003 Liu ..... G06T 7/13 382/266
2004/0013298 A1 * 1/2004 Choe ..... H04N 9/68 348/E9.053
2004/0164946 A1 * 8/2004 Cavanaugh ..... G02F 1/133382 345/101
2005/0213127 A1 * 9/2005 Hoshino ..... H04N 1/603 358/1.9
2005/0276088 A1 * 12/2005 Moon ..... G09G 3/3648 365/63
2005/0286098 A1 * 12/2005 Shyu ..... G09G 5/02 358/1.9
2006/0227085 A1 * 10/2006 Boldt ..... G01J 3/506 348/E17.005
2009/0022395 A1 * 1/2009 Cho ..... H04N 1/60 382/167
2011/0157212 A1 * 6/2011 Zhang ..... G09G 5/02 345/590
2011/0292071 A1 * 12/2011 Kwon ..... G09G 3/3233 345/589
2013/0195353 A1 * 8/2013 Uslubas ..... H04N 1/628 382/167
2013/0249956 A1 * 9/2013 Kang ..... G09G 5/02 345/87
2016/0335984 A1 * 11/2016 Wu ..... G09G 3/2003
2017/0116899 A1 * 4/2017 Matsumoto ..... G09G 3/2003
2020/0327840 A1 * 10/2020 Kobayashi ..... G09G 3/36
2021/0151004 A1 * 5/2021 Kobayashi ..... H04N 9/30

FOREIGN PATENT DOCUMENTS

CN 103780797 A 5/2014
CN 105069756 A 1/2015
CN 105528999 A 4/2016
CN 108364620 A 8/2018
CN 109461417 A 3/2019
CN 109559692 A 4/2019

OTHER PUBLICATIONS

Chao Wang, the International Searching Report, dated Jun. 2020, CN.

* cited by examiner

DRIVING METHOD AND SYSTEM OF DISPLAY PANEL, AND DISPLAY DEVICE

CROSS REFERENCE OF RELATED APPLICATIONS

This application claims the priority to and benefit of Chinese patent application number CN201910275101.2, entitled "Driving Method and System of Display Panel, and Display Device" and filed Apr. 8, 2019, and Chinese patent application number CN201910275213.8, entitled "Driving Method and System of Display Panel, and Display Device" and filed Apr. 8, 2019, with China National Intellectual Property Administration, the entire contents of which are incorporated herein by reference.

TECHNICAL FIELD

This application relates to the field of display technology, and more particularly relates to a driving method and system of a display panel, and a display device.

BACKGROUND

The statements provided in this section are intended for mere purposes of providing background information related to the present application but don't necessarily constitute the prior art.

As science and technology continue to develop and progress, liquid crystal displays (LCDs) have become the mainstream forms of displays due to their thin body, power saving, and low radiation, and have been widely used. Most of the LCDs are backlit-type LCDs, which include a liquid crystal panel and a backlight module. The working principle of the liquid crystal panel consists in placing liquid crystal molecules between two parallel glass substrates, and applying a driving voltage to the two glass substrates to control the rotational direction of the liquid crystal molecules thus refracting light emitted from the backlight module to produce pictures.

Large-size LCD panels mostly use VA (Vertical Alignment) liquid crystal technology or IPS (In-Plane switching) liquid crystal technology. Compared with IPS liquid crystal technology, VA liquid crystal technology has advantages of higher efficiency of production and lower manufacturing costs. However, VA liquid crystal technology has obvious optical defects in terms of optical properties compared with IPS liquid crystal technology. For example, some large-size display panels, especially VA-type liquid crystal driven ones, have color shift problems under large viewing angles.

SUMMARY

In view of the above, it is therefore an object of this application to provide a driving method and system for a display panel, and a display device, which can effectively improve the color shift issue with the display panel.

The application discloses a driving method of a display panel, including the following operations:

receiving a first color signal, converting the first color signal into first brightness normalized signals, and converting the first brightness normalized signals to obtain a first HSV (hue, saturation, value) spatial signal;

obtaining a saturation signal of the first HSV spatial signal, increasing a saturation value of the saturation signal to obtain a second saturation signal and obtain a second HSV spatial signal;

decreasing the minimum value of the first brightness normalized signals according to the second HSV spatial signal to obtain second brightness normalized signals;

converting the second brightness normalized signals to obtain a second color signal; and driving the display panel using the second color signal.

This application further discloses a driving system for a display panel, using the above-described driving method. The driving system includes a receiver, an adjuster, a calculator, a converter, and a driver. The receiver receives a first color signal, converts the first color signal into a first brightness normalized signal, and converts the first brightness normalized signals to obtain a first HSV spatial signal. The adjuster obtains a saturation signal of the first HSV spatial signal, and increases a saturation value of the saturation signal to obtain a second saturation signal and further obtain a second HSV spatial signal. The calculator lowers the minimum value of the first brightness normalized signals according to the second HSV spatial signal to obtain second brightness normalized signals. The converter converts the second brightness normalized signals to obtain a second color signal. The driver drives the display panel using the second color signal.

This application further discloses a display device, which includes the above-mentioned driving system and the display panel driven by the driving system.

In the RGB color system, the color shift issue is significant due to many mixed color components other than the main hue. In this application, the minimum value in the first brightness normalized signals is reduced to reduce the proportion of color mixing thus achieving the purpose of improving color saturation. This can improve the purity of the main hue, and mitigate the color shift of the display panel, making the colors of the display panel brighter. This solution does not sacrifice the aperture ratio of the display panel, and effectively avoids the decrease of the light transmittance of the display panel.

BRIEF DESCRIPTION OF DRAWINGS

The drawings included herein are intended to provide a further understanding of the embodiments of the present application. They constitute a part of the specification, and are used to illustrate the embodiments of the present application, and explain the principle of the present application in conjunction with the specification. Apparently, the drawings in the following description merely represent some embodiments of the present disclosure, and for those having ordinary skill in the art, other drawings may also be obtained based on these drawings without investing creative efforts. In the drawings.

DETAILED DESCRIPTION OF EMBODIMENTS

Hereinafter, this application will be described in further detail in connection with the drawings and some optional embodiments.

Large-size display panels mostly use negative-type VA (Vertical Alignment) liquid crystal technology or IPS (In-Plane switching) liquid crystal technology. Compared with IPS liquid crystal technology, VA liquid crystal technology has advantages of higher efficiency of production and lower manufacturing costs. However, VA liquid crystal technology has obvious optical defects in terms of optical properties compared with IPS liquid crystal technology, which is significant particularly in commercial applications of large-size panels that require a larger viewing angle.

Figure 1:
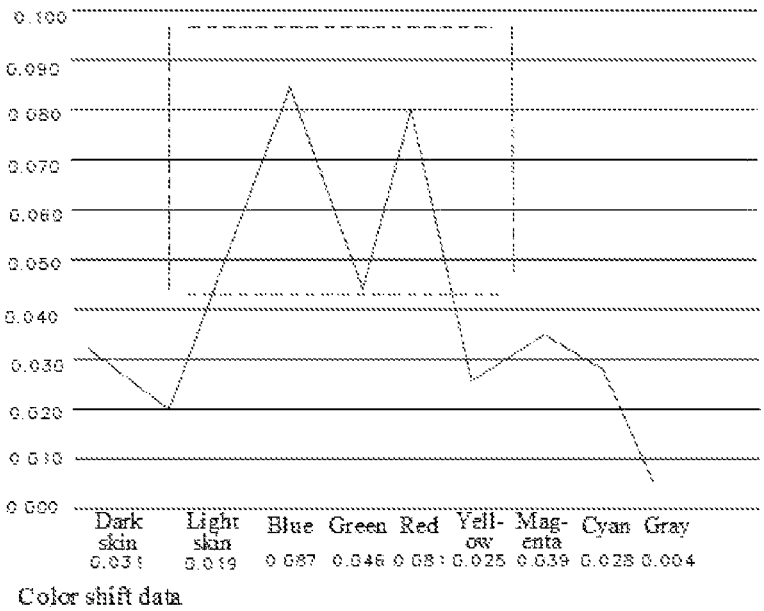
FIG. 1 is a schematic diagram illustrating the changes in the color shifts of various representative color systems in a liquid crystal display panel between a large viewing angle and a front viewing angle.

FIG. 1 is a schematic diagram illustrating the changes in the color shifts of various representative color systems in a liquid crystal display panel between a large viewing angle and a front viewing angle. As illustrated in FIG. 1, when the hue is located close to the pure hues of R (red), G (green), and B (blue), the color shift degradation of viewing angle is relatively significant. In addition, when the hue is close to the pure hues of R, G, and B, the color shift phenomenon becomes more significant. The reason is that the pure hues of R. G, and B have other color components.

Figure 2:
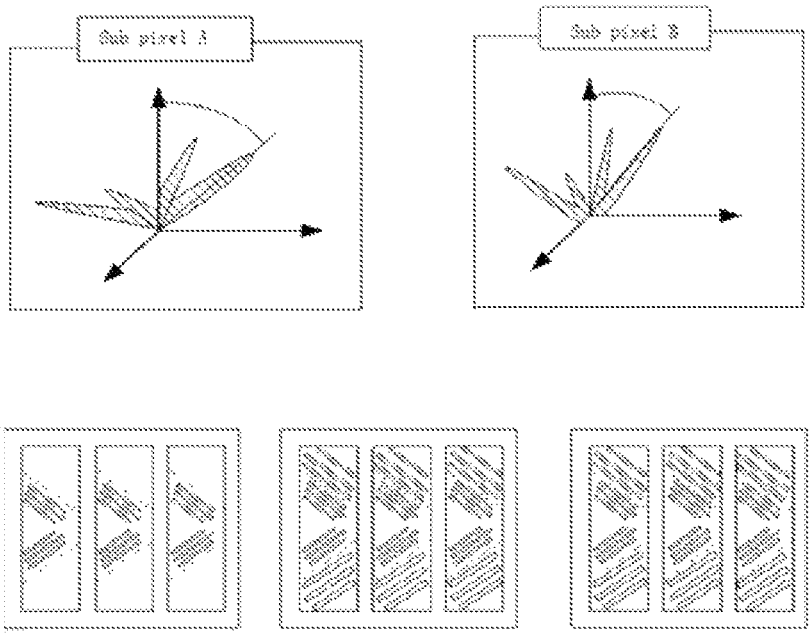
FIG. 2 is a first comparison diagram illustrating a comparison between the case which uses separate main and sub-pixels and the case which doesn't use main and sub-pixels.
Figure 3:
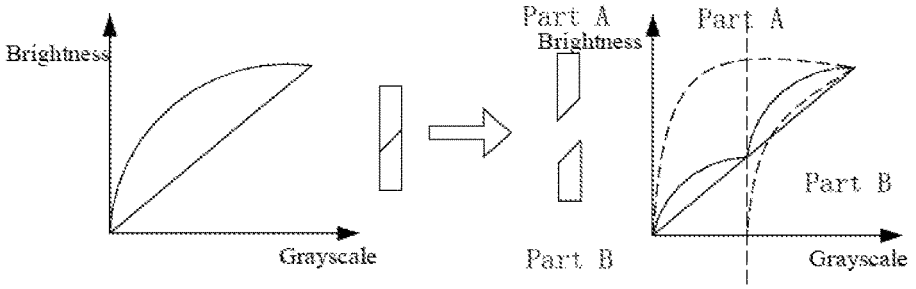
FIG. 3 is a second comparison diagram illustrating a comparison between the case which uses separate main and sub-pixels and the case which doesn't use main and sub-pixels.

An exemplary solution is to subdivide each sub-pixel of RGB into a main pixel and a sub-pixel, so that the changes in the overall large viewing angle brightness along with the voltage may become relatively closer to those in the front view. FIG. 2 is a first comparison diagram illustrating a comparison between the case which uses separate main and sub-pixels and the case which doesn't use main and sub-pixels. FIG. 3 is a second comparison diagram illustrating a comparison between the case which uses separate main and sub-pixels and the case which doesn't use main and sub-pixels. Referring to FIGS. 2 and 3, the x-coordinate, y-coordinate, and z-coordinate respectively represent the three orientations of the three-dimensional space, θA represents the pretilt angle of the main pixel under a large voltage, and θB represents the pretilt angle of the sub-pixel under a small voltage. In FIG. 3, the abscissa denotes the gray-scale signal, and the ordinate denotes the brightness signal. Under a large viewing angle, the brightness saturates rapidly with the signal, causing the problem of large viewing angle color shift (FIG. 3, the arc segment on the left), while distinguishing between main and sub-pixels can alleviate this problem to a certain extent.

The ratio of brightness change to the high voltage side viewing angle voltage on the liquid crystal display is more likely to become saturated, so the original signal is divided into a large voltage plus a small voltage signal. As is illustrated in FIG. 3, the front-view large voltage plus small voltage need to maintain the original front-view signal change ratios with brightness. The variation of the side-view brightness with the gray scale seen at the high voltage is represented by Part A shown in FIG. 3, and the variation of the side-view brightness with the gray scale seen at the small voltage is represented by Part B shown in FIG. 3. In this way, the variation of the combined brightness seen at the side-view with the gray scale would be closer to the relationship between the brightness at the front view with the gray scale, so that the relationship of variation of the viewing angle brightness with the signal would approach the original variation of the signal brightness with the signal, thus improving the viewing angle.

In this solution, the main and sub-pixels are spatially give different driving voltages to solve the viewing angle color shift defects. However, such pixel design often requires redesigning the metal traces or TFT (Thin Film Transistor) elements for purposes of driving the sub-pixels, resulting in sacrifice of the light transmittable opening area, which affects the transmittance of the panel and directly causes the increase in the cost of the backlight.

Figure 4:
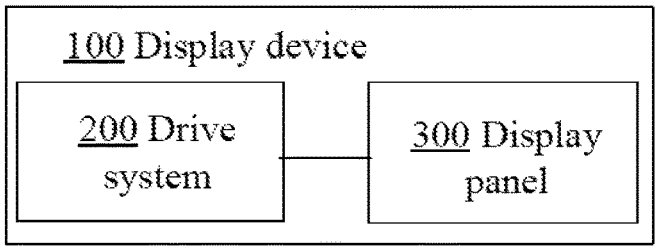
FIG. 4 is a schematic diagram of a display device according to an embodiment of this application.

As illustrated in FIG. 4, as an embodiment according to the present application, a display device 100 is disclosed, which includes a display panel driving system 200 and a display panel 300.

Figure 5:
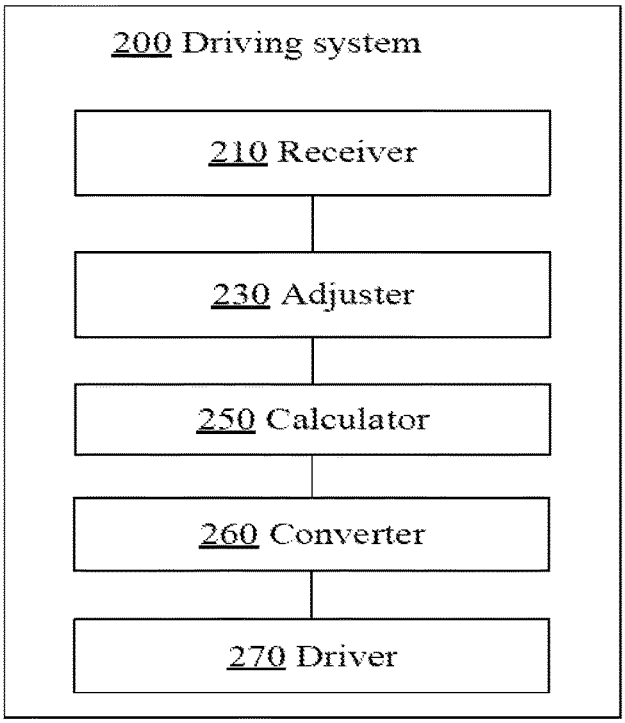
FIG. 5 is a schematic diagram of a driving system of a display panel according to an embodiment of this application.

As illustrated in FIG. 5, a driving system 200 for a display panel is disclosed, the driving system 200 including a receiver 210, an adjuster 230, a calculator 250, a converter 260, and a driver 270. The receiver 210 receives a first color signal, converts the first color signal into a first brightness normalized signal, and converts the first brightness normalized signals to obtain a first HSV spatial signal. The adjuster 230 obtains a saturation signal of the first HSV spatial signal, and increases a saturation value of the saturation signal to obtain a second saturation signal and further obtain a second HSV spatial signal. The calculator 250 lowers the minimum value of the first brightness normalized signals according to the second HSV spatial signal to obtain second brightness normalized signals. The converter 260 converts the second brightness normalized signals to obtain a second color signal. The driver 270 drives the display panel 300 using the second color signal.

Figure 6:
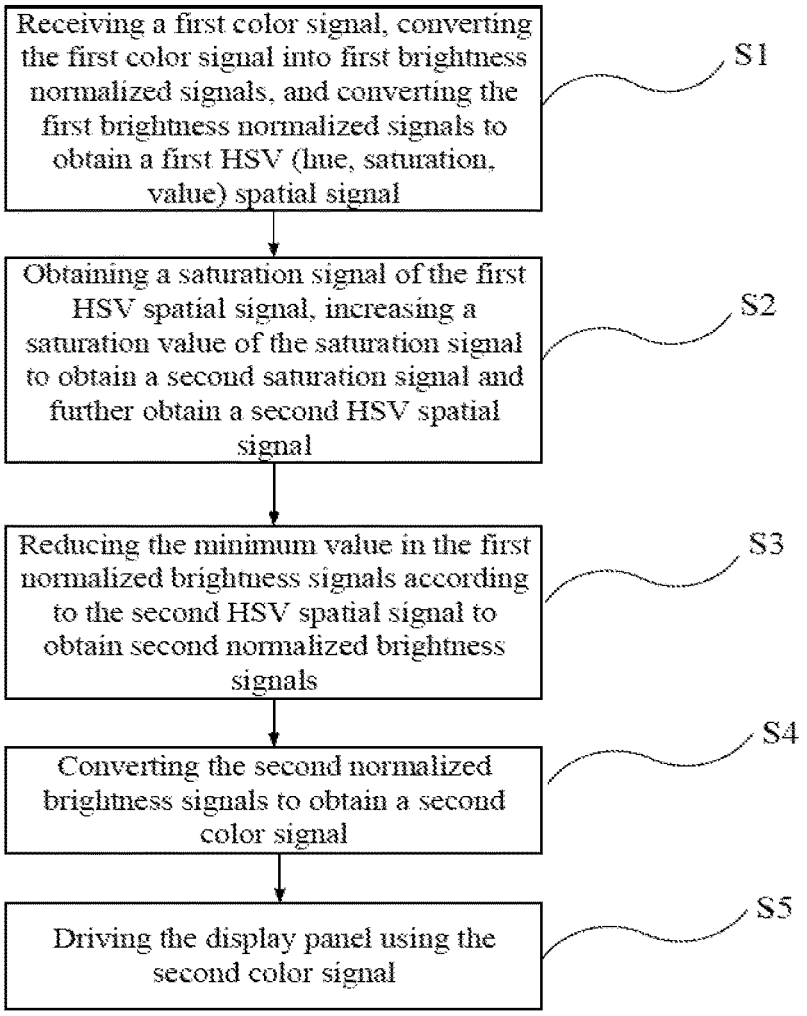
FIG. 6 is a flowchart illustrating a driving method of a display panel according to an embodiment of this application.

Correspondingly, FIG. 6 shows a flowchart of a driving method for driving a display panel according to the present application. As illustrated in FIG. 6, the present application discloses a driving method for driving a display panel, the driving method including the following operations:

S1: receiving a first color signal, converting the first color signal into first brightness normalized signals, and converting the first brightness normalized signals to obtain a first HSV (Hue, Saturation, Value) spatial signal;

S2: obtaining a saturation signal of the first HSV spatial signal, increasing a saturation value of the saturation signal to obtain a second saturation signal and obtain a second HSV spatial signal;

S3: reducing the minimum value of the first brightness normalized signals according to the second HSV spatial signal to obtain second brightness normalized signals;

S4: converting the second brightness normalized signals to obtain a second color signal; and S5: driving the display panel using the second color signal.

In the RGB color system, the color shift issue is significant due to many mixed color components other than the main hue. In this application, the minimum value in the first brightness normalized signals is reduced to reduce the proportion of color mixing thus achieving the purpose of improving color saturation. This can improve the purity of the main hue, and mitigate the color shift of the display panel, making the colors of the display panel brighter. This solution does not sacrifice the aperture ratio of the display panel, and effectively avoids the decrease of the light transmittance of the display panel. In particular, taking red as an example, when the hue is close to the pure red hue, significant color shift degradation may be seen at viewing angles. Accordingly, the brightness normalized signal of the color with the smallest brightness normalized signal in the red pure hue can be reduced to achieve the purpose of increasing the saturation of the main hue in the red pure hue. This reduces the mixing of other colors (green and blue) in the hues with red as the main hue, making the leaking color at large viewing angles close to the original color seen at the front view, thus solving the problem color shift between front and side views. In the above description, the first color signal may be a RGB three-primary-color signal, and the second color signal may be a second RGB three-primary-color signal.

In addition, also taking red as an example, where red is the main hue in the pure red hue, this application may also increase the minimum brightness normalized signal in the brightness normalized signals of other colors in the red pure hue, thereby reducing the saturation of hue with red as the main hue. This will make the mixed color close to the white neutral color, and the main reason that the color shift of the neutral color will be reduced is because all the colors are allowed to leak, so that the mixture of the leaked colors of the three primary colors will not produce a color, that is, the colors of leaked light at the front and side views are a neutral color.

Figure 7:
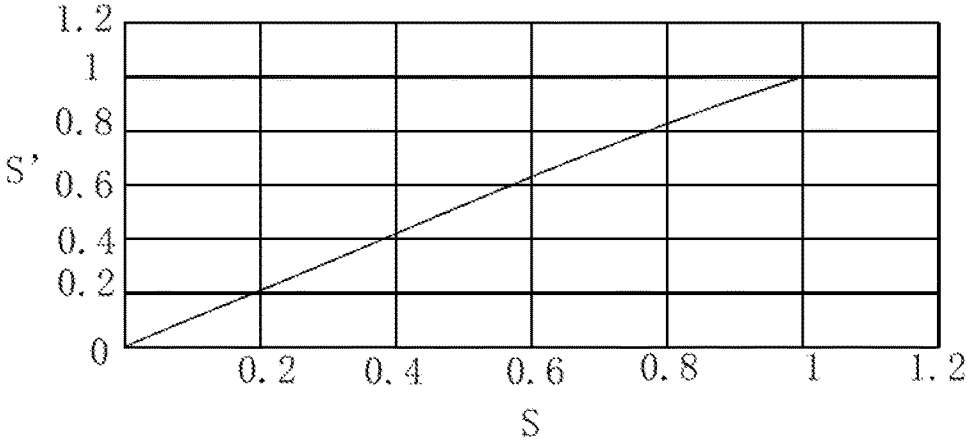
FIG. 7 is a schematic diagram illustrating the changes of a saturation signal and a second saturation signal according to an embodiment of this application.

As illustrated in FIG. 7, the operation S2 of obtaining a saturation signal of the first HSV spatial signal, increasing a saturation value of the saturation signal to obtain a second saturation signal and obtain a second HSV spatial signal may include: obtaining adjustment coefficients according to the hue of the first HSV spatial signal; and adjusting the saturation value of the saturation signal s according to the adjustment coefficients to obtain the second saturation signal s', where the adjustment coefficients satisfy the following formula:

$s'=a\times s^4+b\times s^3+c\times s^2+d\times s+e$, where s denotes the saturation signal, s' denotes the second saturation signal, and a, b, c, d, e are constants. That is, by calculating the second saturation signal s' and driving the display panel using the second saturation signal, the colors of the display panel may be more brilliant and vivid, and the color shift problem may be effectively alleviated.

Figure 8:
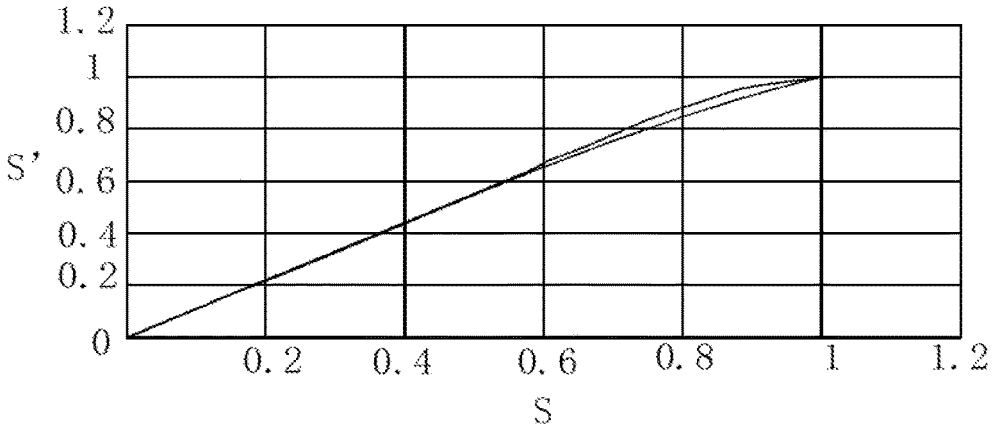
FIG. 8 is a schematic diagram illustrating the changes of a saturation signal and a second saturation signal according to another embodiment of this application.

As illustrated in FIG. 8, the operation of obtaining the adjustment coefficients according to the hue of the first HSV spatial signal may include: dividing the hue H into a number of m hue intervals; and obtaining the adjustment coefficients a(H(m)). B(H(m)), c(H(m)), d(H(m)), e(H(m)) according to the hue intervals, where the more significant the color shift, the larger the adjustment coefficient. The saturation signal s and the second saturation signal s'(H(m),s) corresponding to the hue interval may satisfy the following formula:

$$s'(H(m),s)=a(H(m))\times s^4+b(H(m))\times s'+c(H(m))\times s^2+d(H(m))\times s+e(H(m))$$

Where a(H(m)), b(H(m)), c(H(m)), d(H(m)), e(H(m)) are the saturation adjustment constants of the corresponding hue interval. After the hue (H) is divided into multiple intervals, because different intervals have different degrees of color shift, different adjustments to the saturation can be made according to different intervals, which can increase the color vividness of the display panel, and make adjustment of the color shift more even.

Figure 9:
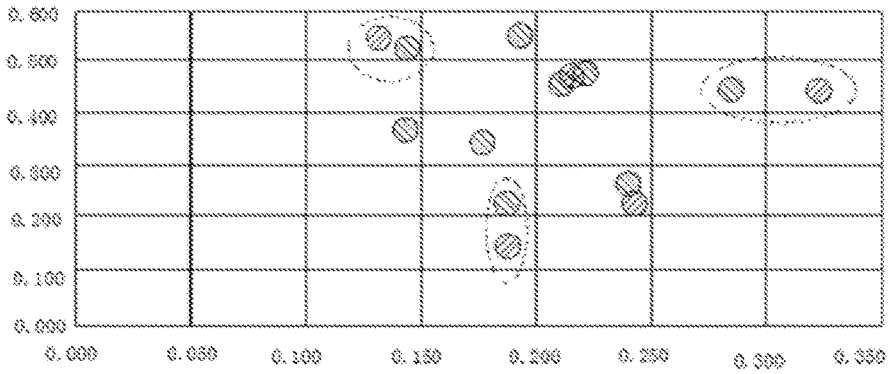
FIG. 9 is a schematic diagram illustrating the changes in the color difference between a saturation signal and a second saturation signal according to an embodiment of this application.
Figure 10:
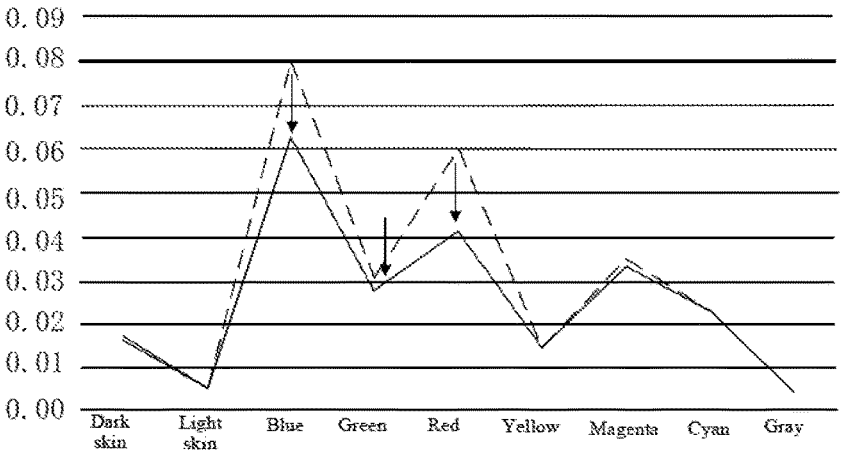
FIG. 10 is a schematic diagram illustrating the changes in the color difference of different colors of the saturation signal and the second saturation signal according to another embodiment of this application.

FIG. 9 shows a curve illustrating the change in the color difference between the current saturation signal and the second saturation signal according to an embodiment of the present application, where the color difference change diagram of FIG. 9 may be in the case of a front viewing angle, or of course, may also be in the case of a side viewing angle. FIG. 10 is a schematic diagram illustrating the changes in the color difference of different colors of the saturation signal and the second saturation signal according to an embodiment of this application. After the saturation is adjusted, the color difference changes are as shown in FIG. 10, and the color difference problem is alleviated.

Figure 11:
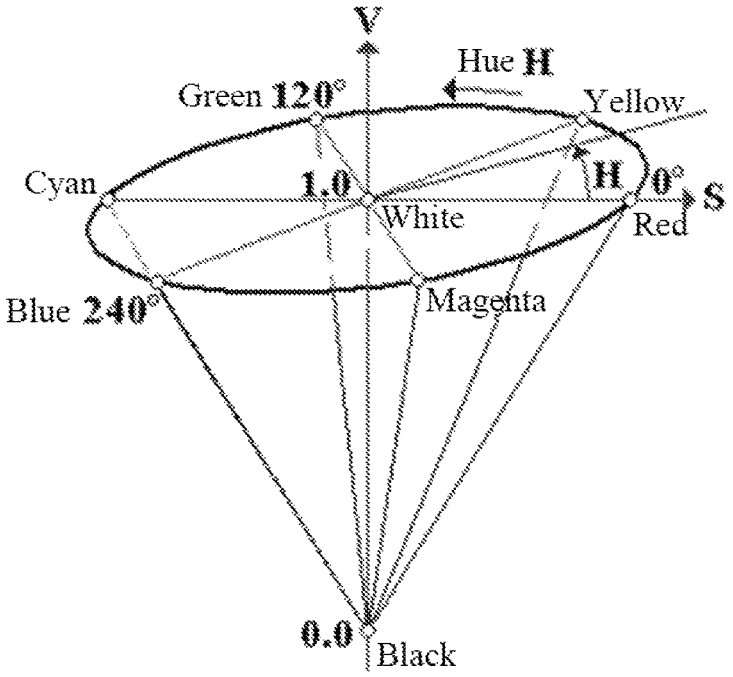
FIG. 11 is a schematic diagram illustrating a hue expression according to an embodiment of this application.

Referring to FIG. 11, according to the definition of HSV provided by the CIE (Commission Internationale de L'Eclairage), the hue (H) refers to different hue colors that are represented by 0° to 360°, where 0° is defied as red, 120° is green, and 240° is blue. The operation S1 of receiving a first color signal, converting the first color signal into a first brightness normalized signal, and converting the first brightness normalized signals to obtain a first HSV (hue, saturation, value) spatial signal may include: inputting the first color signal as gray-scale digital signals R, G, B; convert the gray-scale digital signals to obtain first brightness normalized signals r, g, and b, where r=(R/255)^γr, g=(G/255)^γg, b=(B/255)^γb, where γr, γg, and γb are gamma signals. The formula for converting the first brightness normalized signals r, g, and b into hue h and saturation signal s is as follows:

$$h=\begin{cases}0^\circ & \text{if } \max=\min\\ 60^\circ\times\dfrac{g-b}{\max-\min}+0^\circ & \text{if } \max=r \text{ and } g\geq b\\ 60^\circ\times\dfrac{g-b}{\max-\min}+360^\circ & \text{if } \max=r \text{ and } g<b\\ 60^\circ\times\dfrac{b-r}{\max-\min}+120^\circ & \text{if } \max=g\\ 60^\circ\times\dfrac{r-g}{\max-\min}+240^\circ & \text{if } \max=b\end{cases}$$

$$s=\begin{cases}0^\circ & \text{if } \max=0\\ 1-\dfrac{\min}{\max} & \text{otherwise}\end{cases}$$

where max represents the maximum value in r/g/b, and min represents the minimum value in r/g/b. The saturation value is related to the first brightness normalized signals. When the saturation signal is increased, the corresponding first brightness normalized signal will also change. In particular, when the saturation value is increased by lowering the minimum value of the first brightness normalization signal, the color mixing components other than the main hue are correspondingly lowered, thereby obtaining the first HSV spatial signal with higher color purity. In the above description, the gray-scale digital signals include a red gray-scale digital signal R, a green gray-scale digital signal G, and a blue gray-scale digital signal B; r, g, b are the first brightness normalized signals corresponding to the red gray-scale digital signal R, the green gray-scale digital signal G, and the blue gray-scale digital signal B, respectively; γr, γg, and γb are the gamma signals corresponding to the red gray-scale digital signal R, the green gray-scale digital signal G, and the blue gray-scale digital signal B, respectively. The operation S3 of reducing the minimum value of the first brightness normalized signals according to the second HSV spatial signal to obtain the second brightness normalized signals may include the following, namely, the first red brightness normalized signal r, the first green brightness normalized signal g, and the first blue brightness normalized signal b; the second brightness normalized signals includes: the second red brightness normalized signal r', the second green brightness normalized signal g' and the second blue brightness normalized signal b'; obtaining the minimum value min among the first red brightness normalized signal r, the first green brightness normalized signal g, and the first blue brightness normalized signal b according to the hue of the second HSV spatial signal; reducing the minimum value min among the first red brightness normalized signal r, the first green brightness normalized signal g, and the first blue brightness normalized signal b according to the saturation signal s and the second saturation signal s', to obtain the adjusted minimum value min' and further obtain the second red brightness normalized signal r', the second green brightness normalized signal g', and the first blue brightness normalized signal b'.

The operation of obtaining the minimum value of the first brightness normalized signals according to the hue of the second HSV spatial signal may include the following; when the main hue is red, max is r; determining that the smaller value of the first brightness normalized signals g and b corresponding to green and blue is the minimum value of the first brightness normalized signals; when the main hue is green, max is g; determining that the smaller value of the first brightness normalized signals r and g corresponding to red and blue is the minimum value of the first brightness normalized signals; and when the main hue is blue, max is b; determining that the smaller value of the first brightness normalized signals r and g corresponding to red and green is the minimum value of the first brightness normalized signals. In particular, for example, when the main hue is blue, the max in r, g, b can be determined as b, so there is no need to calculate max, and it is only needed to calculate the smaller value of r and g as the min. In this way, the min may be reduced to reduce the color mixing component while reducing the amount of calculation, thereby reducing the color shift between the front and side views of the display panel.

There are some G and R color components in the B hue, and the amounts of light leakage of the G and R components at a large viewing angle is more significant than that of the front viewing angle, causing color shift of the B main hue after color mixing. By reducing the color components of G and R, this solution reduces the effect of light leakage of G and R at a large viewing angle on the main hue B, thus reducing the viewing angle color shift, while increasing the color purity of the B main hue, thus improving the color vividness. The same also applies to other colors.

Through s'=1−min/max, when green is the main hue, the maximum first brightness normalized signal max is the first green brightness normalized signal g. Thus, while increasing the first green brightness normalized signal g, the minimum first brightness normalized signal min is reduced. Such adjustment allows the minimum first brightness normalized signal min to decrease at a less rate, thereby avoiding the normalized brightness imbalance that may be caused when the minimum first brightness normalized signal min is reduced.

The operation S4 of converting the second brightness normalized signals to obtain the second color signal may include: converting the second brightness normalized signals to obtain the second color signal according to the following calculation formula: $R'=255\times(r')^{1/\gamma r}$, $G'=255\times(g')^{1/\gamma g}$, $B'=255\times(b')^{1/\gamma b}$; where, r', g' and b' are the second brightness normalized signals, and R', G', and B' are altogether the second color signal. Based on the second brightness normalized signals r', g', b', the second color signal R', G', B' is calculated by means of inversion. The second color signal may achieve the purpose of reducing the difference of the color shift between the front view and the side view, which effectively alleviates the color shift and improves the color vividness of the display panel.

In the operation of adjusting the saturation value of the saturation signal s according to the adjustment coefficients to obtain the second saturation signal s', the color difference Δuv between the saturation signal and the second saturation signal may satisfy the following formula: $\Delta uv=\sqrt{(u_1-u_2)^2+(v_1-v_2)^2}\leq 0.02$; where u_1 and v_1 denote chromaticity coordinates of the saturation signal, and u_2 and v_2 denote chromaticity coordinates of the second saturation signal. According to the calculation of the formula, the variation range of the purity can be determined to avoid excessive adjustment of the saturation which may cause other problems. Thus, the adjustment of the saturation can be controlled within a controllable range while effectively alleviating the color shift problem.

As can be seen from FIG. 1, the color shift of the three-primary-color signal close to the pure green hue is significantly smaller than the color shifts of red and blue hues, so:

On the premise of the same saturation value, when the main hue is green, the minimum value of the first brightness normalized signals g and b corresponding to red and blue may be reduced to a relatively greater extent, while when the main hue is red or blue, if the minimum value min of the first brightness normalized signals corresponds to green, the minimum value of the first brightness normalized signals may be reduced to a relatively smaller extent.

Figure 12:
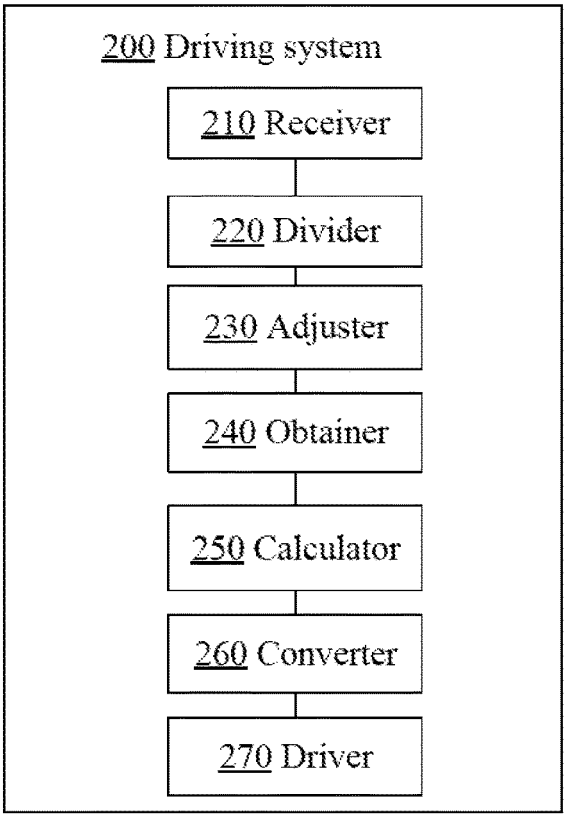
FIG. 12 is a schematic diagram of a driving system of a display panel according to an embodiment of this application.

As another embodiment of the present application as illustrated in FIG. 12, the present application discloses a driving system 200 of a display panel 300, the driving system 200 including a receiver 210, a divider 220, an adjuster 230, an obtainer 240, a calculator 250, a converter 260, and a driver 270. The receiver 210 receives a first color signal, converts the first color signal into a first brightness normalized signal, and converts the first brightness normalized signals to obtain a first HSV spatial signal. The divider 220 divides the first HSV spatial signal into six hue intervals depending on different hues: a first hue, a second hue, a third hue, a fourth hue, a fifth hue, and a sixth hue. The obtainer 230 obtains preset adjustment coefficient, and obtains the hue interval correction value according to the hue interval in which the first HSV spatial signal is located. The adjuster 240 obtains the saturation signal of the first HSV spatial signal, uses the adjustment coefficient and the hue interval correction value to adjust the saturation signal, and obtains a third saturation signal and further obtain the second HSV spatial signal. The calculator 250 reduces the minimum value of the first brightness normalized signals according to the second HSV spatial signal, to obtain the second brightness normalized signals. The converter 260 converts the second brightness normalized signals to obtain the second color signal. And the driver 270 drives the display panel 100 using the second color signal.

Figure 13:
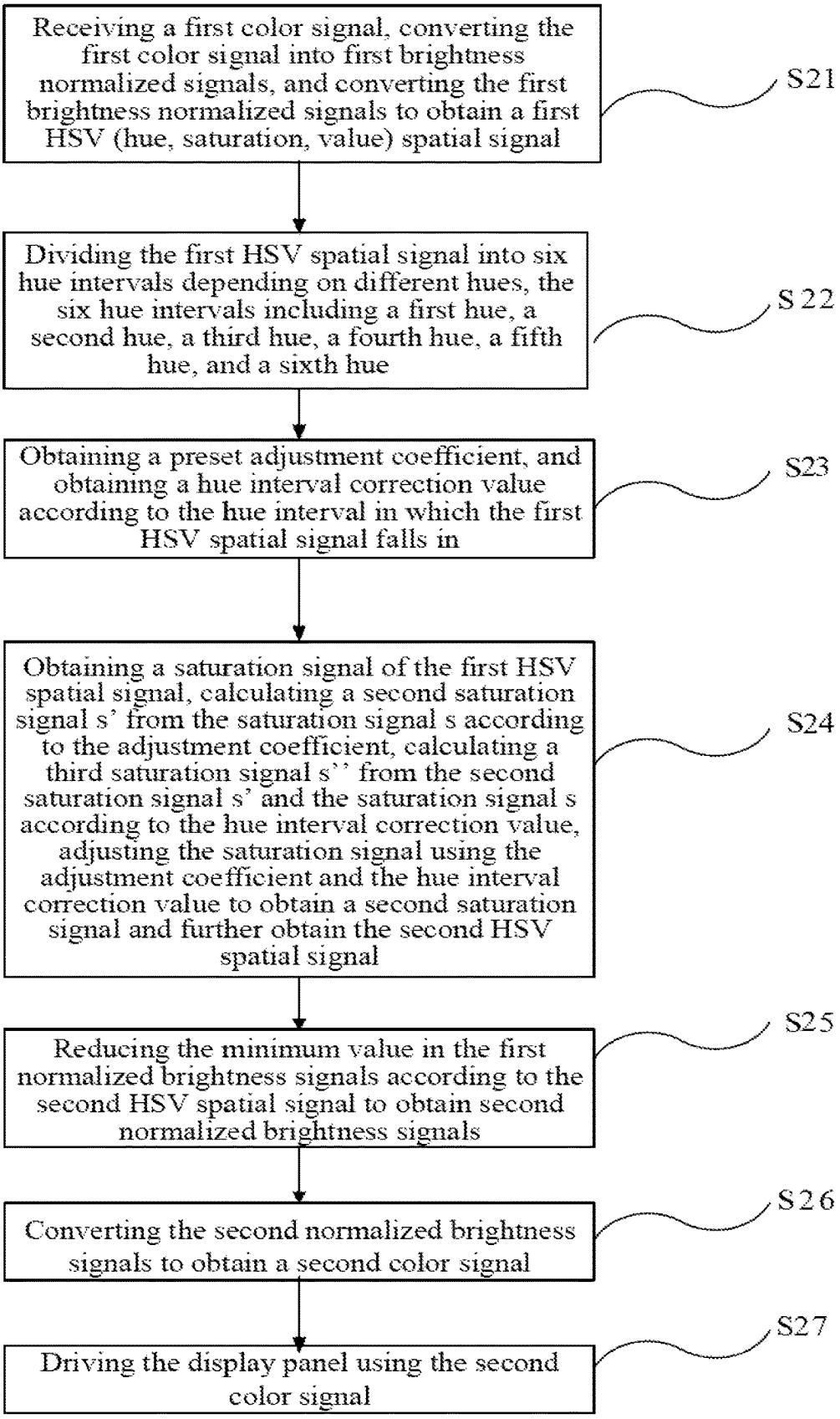
FIG. 13 is a flowchart illustrating a driving method of a display panel according to an embodiment of this application.

Correspondingly, as illustrated in FIG. 13, the present application also discloses a driving method for driving the above-mentioned display panel, the driving method including the following operations:

S21: receiving a first color signal, converting the first color signal into first brightness normalized signals, and converting the first brightness normalized signals to obtain a first HSV (hue, saturation, value) spatial signal:

S22: dividing the first HSV spatial signal into six hue intervals depending on different hues: a first hue, a second hue, a third hue, a fourth hue, a fifth hue, and a sixth hue;

S23: obtaining a preset adjustment coefficient, and obtaining the hue interval correction value according to the hue interval in which the first HSV spatial signal is located:

S24: obtaining the saturation signal of the first HSV spatial signal, adjusting the saturation signal s all according to the adjustment coefficient to obtain the second saturation signal s'; performing an operation with the second saturation signal s' and the saturation signal s according to the hue interval correction value to obtain the third saturation signal s", and adjusting the saturation signal using the adjustment coefficient and the hue interval correction value to obtain the third saturation signal and further obtain the second HSV spatial signal;

S25: reducing the minimum value of the first brightness normalized signals according to the second HSV spatial signal to obtain second brightness normalized signals;

S26: converting the second brightness normalized signals to obtain a second color signal; and S27: driving the display panel using the second color signal.

In the RGB color system, the color shift issue is significant due to many mixed color components other than the main hue. In this application, the minimum value in the first brightness normalized signals is reduced to reduce the proportion of color mixing thus achieving the purpose of improving color saturation, namely improving the purity of the main hue, so that the colors of the display panel can be more vivid and brilliant. In this way, there is no need to divide the pixels into main pixels and sub-pixels. This solution can alleviate the color shift of the display panel without sacrificing the aperture ratio of the display panel, and effectively avoid the decrease of the light transmittance of the display panel. Furthermore, the saturation is adjusted using the combination of the adjustment coefficient and the hue interval correction value, so that the adjustment of the saturation can be more targeted and accurate, and the adjusted results can be more conducive to improving the screen display effects of the display panel. As described herein, the color signal may be a RGB three-primary-color signal. In particular, the first color signal may be a first RGB three-primary-color signal, and the second color signal may be a second RGB three-primary-color signal.

This application considers all hues from 0° to 360°. When divided evenly, they are divided into six hues, namely red, green, blue, yellow, cyan, and magenta (RGBYMC), corresponding to the first, second, third, fourth, fifth, and sixth hues, respectively. In the above description, the three hues of yellow, cyan, and magenta are exactly the mixed hues of two selected from the three primary colors of red, green, and blue.

As illustrated FIG. 11, the hue (H) refers to hue, and different hue colors are represented by 0° to 360°, where 0° is defined as red, 120° is green, and 240° is blue. The operation S1 of receiving a first color signal, converting the first color signal into a first brightness normalized signal, and converting the first brightness normalized signals to obtain a first HSV (hue, saturation, value) spatial signal may include: inputting the first color signal as gray-scale digital signals; converting the gray-scale digital signals to obtain first brightness normalized signals r, g, and b, where r=(R/255)^γr, g=(G/255)^γg, b=(B/255)^γb, where γr, γg, and γb are gamma signals. The operation of obtaining the saturation signal of the first HSV spatial signal may include: converting the first brightness normalized signals into the hue and the saturation is as follows:

$$H = \begin{cases} 0^\circ & \text{if } \max = \min \\ 60^\circ \times \dfrac{g-b}{\max - \min} + 0^\circ & \text{if } \max = r \text{ and } g \geq b \\ 60^\circ \times \dfrac{g-b}{\max - \min} + 360^\circ & \text{if } \max = r \text{ and } g < b \\ 60^\circ \times \dfrac{b-r}{\max - \min} + 120^\circ & \text{if } \max = g \\ 60^\circ \times \dfrac{r-g}{\max - \min} + 240^\circ & \text{if } \max = b \end{cases}$$

$$s = \begin{cases} 0^\circ & \text{if } \max = 0 \\ 1 - \dfrac{\min}{\max} & \text{otherwise} \end{cases}$$

where max represents the maximum value in r/g/b, and min represents the minimum value in r/g/b. The first color signal is based on to calculate the first brightness normalized signals through a formula, and the maximum value max and the minimum value min in the first brightness normalized signals are obtained by means of comparison, and so the hue H and the saturation signal s can be calculated through the above formula.

The operation S25 of reducing the minimum value of the first brightness normalized signals according to the second HSV spatial signal to obtain the second brightness normalized signals may include: when the main hue is red, max is r; determining that the smaller value of the first brightness normalized signals g and b corresponding to green and blue is the minimum value of the first brightness normalized signals; when the main hue is green, max is g; determining that the smaller value of the first brightness normalized signals r and g corresponding to red and blue is the minimum value of the first brightness normalized signals; and when the main hue is blue, max is b; determining that the smaller value of the first brightness normalized signals r and g corresponding to red and green is the minimum value of the first brightness normalized signals. In particular, for example, when the main hue is blue, the max in r, g, b can be determined as b, so there is no need to calculate max, and it is only needed to calculate the smaller value of r and g as the min. In this way, the min may be reduced to reduce the color mixing component while reducing the amount of calculation, thereby reducing the color shift between the front and side views of the display panel. There are some G and R color components in the B hue, and the amounts of light leakage of the G and R components at a large viewing angle is more significant than that of the front viewing angle, causing color shift of the B main hue after color mixing. By reducing the color components of G and R, this solution reduces the effect of light leakage of G and R at a large viewing angle on the main hue B, thus reducing the viewing angle color shift, while increasing the color purity of the B main hue, thus improving the color vividness. The same also applies to other colors.

As illustrated in FIG. 7, the operation of calculating the second saturation signal s' based on the saturation signal s according to the adjustment coefficient may include: calculating the second saturation signal s' from the saturation signal s according to the following formula:

$$s'=a\times s^4+b\times s^3+c\times s^2+d\times s+e;$$

where s denotes the saturation signal, s' denotes the second saturation signal, and a, b, c, d, e are adjustment coefficients, which are constants. Depending on different hues, the constant values a, b, c, d, e can be changed, and so the second saturation signal s' calculated by the formula from the saturation signal s may also be different, thus realizing adaptive adjustment of the saturation.

Figure 14:
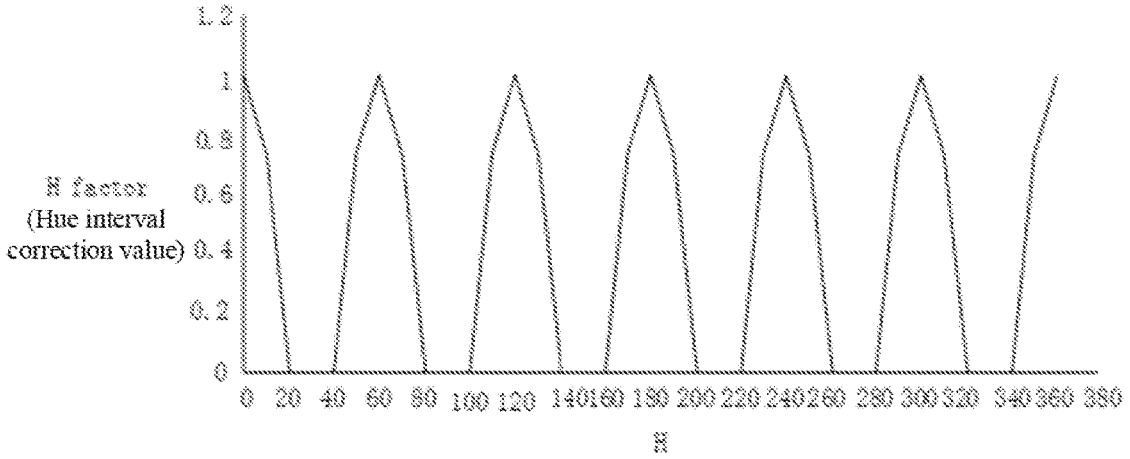
FIG. 14 is a schematic diagram illustrating the changes in hues and hue interval correction values according to an embodiment of this application.

As illustrated in FIG. 14, the operation of calculating the third saturation signal s" based on the second saturation signal s' and the saturation signal s according to the hue interval correction value may include: calculating the third saturation signal s" based on the second saturation signal s' and the saturation signal s according to the following formula:

$$s''=s+(s'-s)\times H\text{ factor};$$

where s denotes the color saturation signal, s' is the second saturation signal, and s" denotes the third saturation signal, H factor follows the following formula:

$$H\text{ factor}=2\left|\sin\left(\left(\frac{H}{180}\times 3-\frac{1}{2}\right)\times\pi\right)\right|-1.$$

After the saturation signal s is converted into the second saturation signal s', the coarse adjustment has been completed. Furthermore, because in the same hue interval, the closer to the main hue, the more significant the color shift, in this solution, the hue correction value is made greater the closer it is to the main hue. At this point, the magnitude of the coarse adjustment has made it close to the target of adjustment, so the adjustment result of the coarse adjustment is barely changed during the fine adjustment. Accordingly, when the color shift problem of the HSV color space is very insignificant, the magnitude of the coarse adjustment would be too large. Therefore, multiplying by a smaller hue correction value can mitigate its adjustment magnitude to avoid the loss of saturation to the largest extent possible while improving the color shift problem, thereby making the adjustment of the saturation signal more accurate. As a result, it can realize the adjustment of saturation signals to different degrees for hue intervals having different degrees of color shift.

Figure 15:
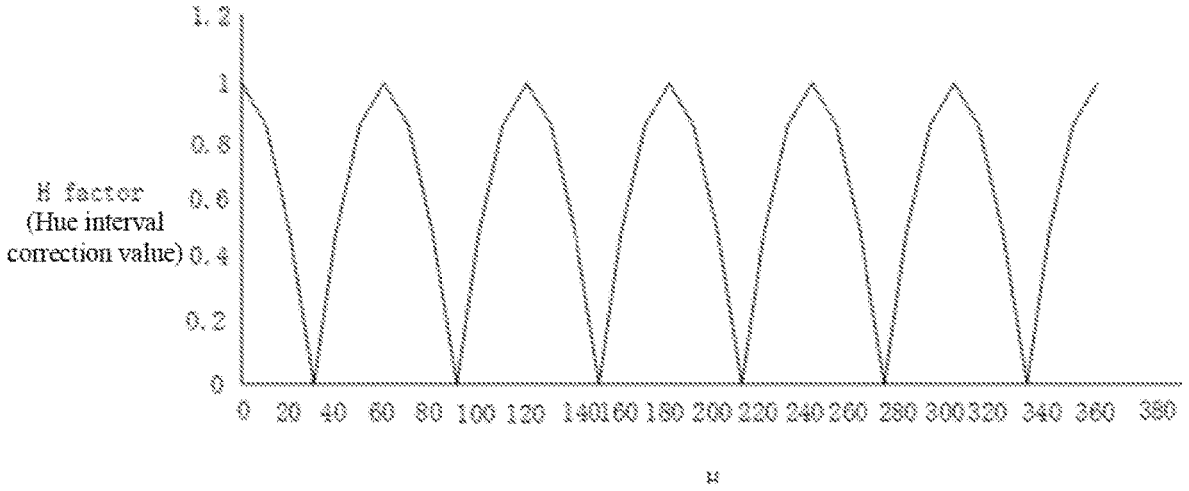
FIG. 15 is a schematic diagram illustrating the changes in hues and hue interval correction values according to another embodiment of this application.

As illustrated in FIG. 15, in one embodiment, the operation of calculating the third saturation signal s" based on the second saturation signal s' and the saturation signal s according to the hue interval correction value may include: calculating the third saturation signal s" based on the second saturation signal s' and the saturation signal s according to the following formula:

$$s''=s+(s'-s)\times H\text{ factor};$$

where s denotes the color saturation signal, s' is the second saturation signal, and s" denotes the third saturation signal, H factor follows the following formula:

$$H\text{ factor}=\left|\sin\left(\left(\frac{H}{180}\times 3-\frac{1}{2}\right)\times\pi\right)\right|.$$

After the saturation signal s is converted into the second saturation signal s', in order to make the adjustment of the saturation signal more accurate so as to achieve adjustment of saturation signals to different degrees for hue intervals having different degrees of color shift, s' may be further converted into s" according to the hue interval correction value H factor, thus realizing precise adjustment for different degrees of color shift.

The hue intervals to which the hue is divided may further include non-adjusted hue intervals in addition to the six hue intervals that need to be adjusted, where the six hue intervals include six hue intervals, namely a first hue, a second hue, a third hue, a fourth hue, a fifth hue, and a six hue. Then it is determined as to whether the hue lies within the six hue intervals including the first hue, the second hue, the third hue, the fourth hue, the fifth hue and the sixth hue. If the hue lies within the six hue intervals, a correction adjustment coefficient may be calculated according to the adjustment coefficients and the hue interval correction value; otherwise, the saturation adjustment is not performed, and the saturation signal s is adjusted using the adjustment coefficient to obtain the third saturation signal s", where the correction adjustment coefficient is obtained by looking up a table.

In this application, the saturation signal s is increased to the second saturation signal s' when addressing the above six hue intervals, and then the third saturation signal s" is obtained through the hue interval correction value. Thus, the hue interval correction value maintains the hue with increased saturation, while regarding the mixed colors in the middle of the above six hue intervals, the saturation signal s is not adjusted to s' and the original saturated color is maintained, thus reducing the impact on the image quality and the colors.

By first determining the hue interval, then calculating the correction adjustment coefficient based on the adjustment coefficient and the hue interval correction value, and then adjusting the saturation signal s to the third saturation signal s" through the correction adjustment coefficient, the step of adjusting the saturation signal s to s' by the adjustment coefficient is not needed, which greatly reduces the amount of calculation. In addition, it is not needed to correct and adjust the saturation signal s' that does not lie in the intervals and that has not been adjusted when performing operations according to the hue interval correction value. A specific example of this solution is as follows. Assuming that the adjustment coefficient is 1.1 and the correction value of the red hue interval is 0.8, then for the saturation signal s in the red hue interval, the correction adjustment coefficient is first calculated as: $1.1\times 0.8=0.88$, and then the correction adjustment coefficient is operated with the saturation signal s to obtain the third saturation signal s".

In different hue intervals, the hue interval correction value may have an individually different weight coefficient A. When it is determined that the hue interval where the first HSV spatial signal is located is individually the red hue interval, green hue interval, blue hue interval, yellow hue interval, cyan hue interval, or the magenta hue interval, the weights that need to be multiplied with the hue interval correction value may be $A_{red}$, $A_{green}$, $A_{blue}$, $A_{yellow}$, $A_{cyan}$ or $A_{magenta}$, individually.

The hue interval correction values corresponding to the red hue interval, green hue interval, blue hue interval, yellow hue interval, cyan hue interval, or magenta hue interval are H factor×$A_{red}$, H factor×$A_{green}$, H factor×$A_{blue}$, H factor×$A_{yellow}$, H factor×$A_{cyan}$, or H factor×$A_{magenta}$, respectively, where at least the red hue interval correction value H factor×$A_{red}$ is greater than the green hue interval correction value H factor×$A_{green}$, and the weights are obtained according to a look-up table. The greater the H factor and the greater the weight A, then the greater the hue interval correction value and the greater the adjustment magnitude, hence the greater the increase in the saturation corresponding to a certain main hue. As described above, the weight A may be subjected to different changes depending on different hues. According to FIG. 1, it can be seen intuitively that the color shift of the red pure hue is obviously greater than the color shift of the green hue. Accordingly, in this solution, the red hue interval correction value is greater than the green hue interval correction value, so that the red hue can be adjusted to a larger extent than the green hue, thus making the degrees of color shift of the two hues approach moving in a convergent direction while improving the color shift.

As illustrated in FIG. 14, the hue function is an outward decreasing function centered on R Hue=0. Y Hue=60, G Hue=120, C Hue=180, B Hue=240, and M Hue=300. When the hue H value of the current saturation signal s falls in the hue interval shown in the following formulas, it is divided into a hue interval to be adjusted. In particular, the hue interval that satisfies the following formula is assigned as the red hue interval: 340≤H, H≤20. The hue interval whose hue value meets the following formula is assigned as the yellow hue interval: 40≤H≤80. The hue interval whose hue value meets the following formula is assigned as the green hue interval: 100≤H≤140. The hue interval whose hue value meets the following formula is assigned as the cyan hue interval: 160≤H≤200. The hue interval whose hue value satisfies the following formula is assigned as the blue hue interval: 220≤H≤260. The hue interval whose hue value satisfies the following formula is assigned as the magenta hue interval: 280≤H≤320.

When the hue H value of the current saturation signal s falls in the hue interval of the following formula, it is assigned as hue interval not to be adjusted: 20<H<40, 80<H<100, 140<H<160, 200<H<220, 260<H<280 or 320<H<340. According to the function formula:

$$H\ \text{factor} = 2\left|\sin\left(\left(\frac{H}{180}\times 3-\frac{1}{2}\right)\times\pi\right)\right|-1,$$

when R Hue=0, Y Hue=60, G Hue=120, C Hue=180, B Hue=240 or M Hue=300, H factor=1, where H is short for Hue.

As illustrated in FIG. 15, the hue function is an outward decreasing function centered on R Hue=0. Y Hue=60, G Hue=120, C Hue=180, B Hue=240, and M Hue=300. When the hue value H of the current saturation signal s falls in the hue intervals of the following formulas, it is assigned as the hue interval to be adjusted. When the hue H value of the current saturation signal s falls in the hue intervals of the following formulas, it is assigned as the hue interval to be adjusted: 330<H. H≤30, 30<H≤90, 90<H≤150, 150<H≤210, 210<H≤270 or 270<H≤330. According to the function formula:

$$H\ \text{factor} = \left|\sin\left(\left(\frac{H}{180}\times 3-\frac{1}{2}\right)\times\pi\right)\right|,$$

when R Hue=0, Y Hue=60, G Hue=120, C Hue=180, B Hue=240 or M Hue=300, H factor=1, where H is short for Hue.

As illustrated in FIG. 9 and FIG. 10, the second brightness normalized signals is deduced according to the second saturation signal, and then the second brightness normalized signals is converted into the second color signal, according to the following formulas: $R'=255\times(r')^{1/\gamma r}$, $G'=255\times(g')^{1/\gamma g}$, $B'=255\times(b')^{1/\gamma b}$, where the second color signal is used to drive the display panel.

This application also discloses another embodiment, including receiving the red, green and blue primary color signals R, G, B, and converting the red, green and blue primary color signals R, G, B into the first brightness normalized signals r, g, b according to the formulas: r=(R/255)^γr, g=(G/255)^γg, b=(B/255)^γb, where γr, γg, and γb are gamma signals; obtaining the first HSV spatial signal according to the first brightness normalized signals r, g, b;

dividing the hue of the first HSV spatial signal into six hue intervals depending on different hues, namely red hue interval: 340<H, H<20, green hue interval: 100<H<140, blue hue interval 220<H<260, yellow hue interval 40<H<80, cyan hue interval 160<H<200, and magenta hue interval: 280<H<320; calculating the saturation signal s of the first HSV spatial signal depending on different hue intervals according to the following formula:

$$h=\begin{cases} 0^\circ & \text{if max} = \text{min} \\ 60^\circ\times\dfrac{g-b}{\text{max}-\text{min}}+0^\circ & \text{if max} = r \text{ and } g\geq b \\ 60^\circ\times\dfrac{g-b}{\text{max}-\text{min}}+360^\circ & \text{if max} = r \text{ and } g<b \\ 60^\circ\times\dfrac{b-r}{\text{max}-\text{min}}+120^\circ & \text{if max} = g \\ 60^\circ\times\dfrac{r-g}{\text{max}-\text{min}}+240^\circ & \text{if max} = b \end{cases}$$

$$s=\begin{cases} 0^\circ & \text{if max} = 0 \\ 1-\dfrac{\text{min}}{\text{max}} & \text{otherwise} \end{cases}$$

obtaining the preset adjustment coefficients a, b, c, d, e, and the hue interval correction value H factor according to the hue interval in which the hue of the first HSV spatial signal lies, where the hue interval correction value H factor is obtained by the following formulas:

$$H\ \text{factor} = 2\left|\sin\left(\left(\frac{H}{180}\times 3-\frac{1}{2}\right)\times\pi\right)\right|-1;$$

where max represents the maximum value in r/g/b, and min represents the minimum value in r/g/b; then the adjustment coefficients a, b, c, d, e are used to adjust the saturation signal s to obtain the second saturation signal s' according to the following formula: $s'=a\times s^4+b\times s^3+c\times s^2+d\times s+e$;

Then the saturation signal s is adjusted by the hue interval correction value H factor to obtain the third saturation signal s" according to the following formula: $s''=s+(s'-s)\times H$ factor, and then the second HSV spatial signal is obtained;

Then the minimum value of the first brightness normalized signals is reduced according to the second HSV spatial signal to obtain the second brightness normalized signals r', g', b'; the second brightness normalized signals r', g', b' are converted into the second red, green and blue three primary color signals R', G', B' according to formula: $R'=255\times(r')^{1/\gamma r}$, $G'=255\times(g')^{1/\gamma g}$, $B'=255\times(b')^{1/\gamma b}$; and the second red, green and blue three primary color signals R', G', B' are used to drive the display panel.

It should be noted that the various steps defined in this solution are not to be construed as limiting the order in which these steps are performed, on the premise of not affecting the implementation of the specific solution. In other words, the steps written earlier may be performed first, or may also be performed later, or may even be performed simultaneously. As long as the solution is able to be implemented, they variations shall all be regarded as falling in the scope of protection of this application.

The technical solutions of this application may be widely used in various display panels, such as TN (Twisted Nematic) display panels, IPS (In-Plane Switching) display panels, VA (Vertical Alignment) 1) Display panel, MVA (Multi-Domain Vertical Alignment) display panels. Of course, the above solutions may also be applicable to other types of display panels, such as OLED (Organic Light-Emitting Diode) display panels, The foregoing is merely a further detailed description of the present application in connection with some specific illustrative implementations, and it is to be construed as limiting the implementation of the present application to these implementations. For those having ordinary skill in the technical field to which this application pertains, numerous simple deductions or substitutions may be made without departing from the concept of this application, which shall all be regarded as falling in the scope of protection of this application.

What is claimed is:

1. A driving method of a display panel, comprising:

receiving a first color signal, converting the first color signal into first brightness normalized signals, and converting the first brightness normalized signals to obtain a first HSV (hue, saturation, value) spatial signal;

obtaining a saturation signal of the first HSV spatial signal, increasing a saturation value of the saturation signal to obtain a second saturation signal and further obtain a second HSV spatial signal;

reducing a minimum value of the first brightness normalized signals according to the second HSV spatial signal to obtain second brightness normalized signals;

converting the second brightness normalized signals to obtain a second color signal; and driving the display panel using the second color signal;

wherein the operation of obtaining a saturation signal of the first HSV spatial signal, increasing a saturation value of the saturation signal to obtain a second saturation signal and further obtain a second HSV spatial signal comprises:

obtaining an adjustment coefficient according to a hue of the first HSV spatial signal; and adjusting the saturation value of the saturation signal s according to the adjustment coefficient to obtain the second saturation signal s';

wherein the adjustment coefficient satisfies the following formula:

$$s'=a\times s^4+b\times s^3+c\times s^2+d\times s+e;$$

where s denotes the saturation signal, s' denotes the second saturation signal, and a, b, c, d, e are constants.

2. The driving method of claim 1, wherein the operation of receiving a first color signal, converting the first color signal into a first brightness normalized signal, and converting the first brightness normalized signals to obtain a first HSV spatial signal comprises:

inputting the first color signal as grayscale digital signals R, G, B; and converting the grayscale digital signals to obtain the first brightness normalized signals r, g, and b, wherein r=(R/255)^γr, g=(G/255)^γg, b=(B/255)^γb, where γr, γg, γb are gamma signals; and converting the first brightness normalized signals r, g, b into a hue h and a saturation signal s according to the following formulas:

$$h=\begin{cases} 0^\circ & \text{if } \max=\min \\ 60^\circ\times\dfrac{g-b}{\max-\min}+0^\circ & \text{if } \max=r \text{ and } g\geq b \\ 60^\circ\times\dfrac{g-b}{\max-\min}+360^\circ & \text{if } \max=r \text{ and } g<b \\ 60^\circ\times\dfrac{b-r}{\max-\min}+120^\circ & \text{if } \max=g \\ 60^\circ\times\dfrac{r-g}{\max-\min}+240^\circ & \text{if } \max=b \end{cases}$$

$$s=\begin{cases} 0^\circ & \text{if } \max=0 \\ 1-\dfrac{\min}{\max} & \text{otherwise} \end{cases}$$

where max represents the maximum value in r/g/b, and min represents the minimum value in r/g/b.

3. The driving method of claim 2, wherein the first brightness normalized signals comprise a first red brightness normalized signal r, a first green brightness normalized signal g, and a first blue brightness normalized signal b; the second brightness normalized signals comprise a second red brightness normalized signal r', a second green brightness normalized signal g', and a second blue brightness normalized signal b', and wherein the operation of reducing the minimum value of the first brightness normalized signals according to the second HSV spatial signal to obtain second brightness normalized signals comprises:

second red brightness normalized signal r obtaining the minimum value min among the first red brightness normalized signal r, the first green brightness normalized signal g, and the first blue brightness normalized signal b, according to the hue of the second HSV spatial signal; and reducing the minimum value min among the first red brightness normalized signal r, the first green brightness normalized signal g, and the first blue brightness normalized signal b to obtain an adjusted minimum min' and further obtain the second red brightness normalized signal r', the second green brightness normalized signal g', and the second blue brightness normalized signal b'.

4. The driving method of claim 3, wherein the operation of obtaining the minimum value min of the first brightness normalized signals according to the hue of the second HSV spatial signal comprises:

when a main hue is red, max is r;

determining that a smaller value of the first brightness normalized signals g and b corresponding to green and blue is the minimum value of the first brightness normalized signals;

when a main hue is green, max is g;

determining that a smaller value of the first brightness normalized signals r and b corresponding to red and blue is the minimum value of the first brightness normalized signals;

when a main hue is blue, max is b;

determining that a smaller value of the first brightness normalized signals r and g corresponding to red and green is the minimum value of the first brightness normalized signals.

5. The driving method of claim 3, wherein the operation of converting the second brightness normalized signals to obtain a second color signal comprises:

converting the second brightness normalized signals to obtain the second color signal according to the following formulas:

$$R'=255\times(r')^{1/\gamma r},\ G'=255\times(g')^{1/\gamma g},\ B'=255\times(b')^{1/\gamma b};$$

where r', g', and b' denote the second brightness normalized signals, and R', G', B' altogether denote the second color signal.

6. The driving method of claim 1, wherein in the operation of adjusting the saturation value of the saturation signal s according to the adjustment coefficient to obtain the second saturation signal s', a color difference Δuv between the saturation signal s and the second saturation signal s' satisfies the following formula:

$\Delta uv=\sqrt{(u_1-u_2)^2+(v_1-v_2)^2}\leq 0.02$; where u_1 and v_1 represent chromaticity coordinates of the saturation signal s, and u_2 and v_2 represent chromaticity coordinates of the second saturation signal s'.

7. The driving method of claim 1, wherein the operation of obtaining an adjustment coefficient according to a hue of the first HSV spatial signal comprises:

dividing the hue H into a number of m hue intervals;

obtaining adjustment coefficients a(H(m)), b(H(m)), c(H(m)), d(H(m)), and e(H(m)) depending on the hue interval;

wherein the more significant the color shift, the larger the adjustment coefficient;

wherein the saturation signal s and the second saturation signal s'(H(m),s) corresponding to the hue interval satisfy the following formula:

$$s'(H(m),\ s)=a(H(m))\times s^4+b(H(m))\times s^3+c(H(m))\times s^2+d(H(m))\times s+e(H(m))$$

where a(H(m)), b(H(m)), c(H(m)), d(H(m)), e(H(m)) denote saturation adjustment constants of the corresponding hue interval.

8. The driving method of claim 1, wherein the operation of obtaining a saturation signal of the first HSV spatial signal, increasing a saturation value of the saturation signal to obtain a second saturation signal and further obtain a second HSV spatial signal comprises:

obtaining a saturation signal of the first HSV spatial signal;

calculating a second saturation signal s' from the saturation signal s according to an adjustment coefficient;

calculating a third saturation signal s" from the second saturation signal s' and the saturation signal s according to an hue interval correction value; and adjusting the saturation signal using the adjustment coefficient and the hue interval correction value to obtain the third saturation signal and further obtain the second HSV spatial signal.

9. The driving method of claim 8, further comprising the following operations subsequent to the operation of receiving a first color signal, converting the first color signal into a first brightness normalized signal, and converting the first brightness normalized signals to obtain a first HSV spatial signal:

dividing the first HSV spatial signal into six hue intervals depending on different hues, the six hue intervals comprising a first hue, a second hue, a third hue, a fourth hue, a fifth hue, and a sixth hue;

obtaining a preset adjustment coefficient, and obtaining the hue interval correction value according to the hue interval in which the first HSV spatial signal falls in.

10. The driving method of claim 8, wherein the operation of calculating a second saturation signal s' based on the saturation signal s according to an adjustment coefficient comprises:

calculating the second saturation signal s' from the saturation signal s according to the following formula:

$$s'=a\times s^4+b\times s^3+c\times s^2+d\times s+e;$$

where s denotes the saturation signal, s' denotes the second saturation signal, and a, b, c, d, e are constants.

11. The driving method of claim 10, wherein the operation of calculating the third saturation signal s" from the second saturation signal s' and the saturation signal s according to the hue interval correction value comprises:

calculating the third saturation signal s" from the second saturation signal s' and the saturation signal s according to the following formula:

$$s''=s+(s'-s)\times H\ \text{factor};$$

where s denotes the saturation signal, s' denotes the second saturation signal, and H factor satisfies the following formula:

$$H\ \text{factor}=2\left|\sin\left(\left(\frac{H}{180}\times 3-\frac{1}{2}\right)\times\pi\right)\right|-1.$$

12. The driving method of claim 10, wherein the operation of calculating the third saturation signal s" from the second saturation signal s' and the saturation signal s according to the hue interval correction value comprises:

calculating the third saturation signal s" from the second saturation signal s' and the saturation signal s according to the following formula:

$$s''=s+(s'-s)\times H\text{factor};$$

where s denotes the saturation signal, s' denotes the second saturation signal, and H factor satisfies the following formula:

$$H\ \text{factor} = \left|\sin\left(\left(\frac{H}{180}\times 3-\frac{1}{2}\right)\times\pi\right)\right|.$$

13. The driving method of claim 11, wherein the hue interval correction value for each different hue interval is assigned a different weight coefficient A;

wherein when it is determined that the hue interval in which the first HSV spatial signal falls is a red hue interval, a green hue interval, a blue hue interval, a yellow hue interval, a cyan hue interval, or a magenta hue interval, the weight to be multiplied with the hue interval correction value is $A_{red}$, $A_{green}$, $A_{blue}$, $A_{yellow}$, $A_{cyan}$, or $A_{meganta}$, correspondingly; and the hue interval correction value corresponding to the red hue interval, the green hue interval, the blue hue interval, the yellow hue interval, the cyan hue interval, or the magenta hue interval is H factor×$A_{red}$, H factor×$A_{green}$, H factor×$A_{blue}$, H factor×$A_{yellow}$, H factor×$A_{cyan}$, or H factor×$A_{meganta}$, correspondingly, where at least the red hue interval correction value H factor×$A_{red}$ is greater than the green hue interval correction value H factor×$A_{green}$.

14. The driving method of claim 9, wherein the current saturation signal s having a hue value H that falls in the hue intervals of the following formulas is designated to be a hue interval to be adjusted:

the hue interval with a hue value that satisfies the following formula is the red hue interval: 340≤H≤20;

the hue interval with a hue value that satisfies the following formula is the yellow hue interval: 40≤H≤80;

the hue interval with a hue value that satisfies the following formula is the green hue interval: 100≤H≤140;

the hue interval with a hue value that satisfies the following formula is the cyan hue interval: 160≤H≤200; the hue interval with a hue value that satisfies the following formula is the blue hue interval: 220≤H≤260;

the hue interval with a hue value that satisfies the following formula is the magenta hue interval: 280≤H≤320;

if the hue value H of the current saturation signal s falls in the hue intervals defined by the following formulas, the current saturation signal s is designated to be a hue interval not to be adjusted: 20<H<40, 80<H<100, 140<H<160, 200<H<220, 260<H<280, or 320<H<340.

15. The driving method of claim 9, wherein if a hue value H of a current saturation signal s falls in the hue intervals defined by the following formulas, the current saturation signal is designated to be a hue interval to be adjusted: 330<H≤30, 30<H≤90, 90<H≤150, 150<H≤210, 210<H≤270, or 270<H≤330.

16. A driving system using a driving method of a display panel, the driving system comprising:

a receiver, configured for receiving a first color signal, converting the first color signal into a first brightness normalized signal, and converting the first brightness normalized signals to obtain a first HSV (hue, saturation, value) spatial signal;

an adjuster, configured for obtaining a saturation signal of the first HSV spatial signal, increasing a saturation value of the saturation signal to obtain a second saturation signal and further obtain a second HSV spatial signal;

a calculator, configured for reducing a minimum value of the first brightness normalized signals according to the second HSV spatial signal to obtain second brightness normalized signals;

a converter, configured for converting the second brightness normalized signals to obtain a second color signal; and a driver, configured for driving the display panel using the second color signal;

wherein the operation of obtaining a saturation signal of the first HSV spatial signal, increasing a saturation value of the saturation signal to obtain a second saturation signal and further obtain a second HSV spatial signal comprises:

obtaining an adjustment coefficient according to a hue of the first HSV spatial signal; and adjusting the saturation value of the saturation signal s according to the adjustment coefficient to obtain the second saturation signal s';

wherein the adjustment coefficient satisfies the following formula:

$$s'=a\times s^4+b\times s^3+c\times s^2+d\times s+e;$$

where s denotes the saturation signal, s' denotes the second saturation signal, and a, b, c, d, e are constants.

17. The driving system of claim 16, further comprising:

a divider configured for dividing the first HSV spatial signal into six hue intervals depending on different hues, the six hue intervals comprising a first hue, a second hue, a third hue, a fourth hue, a fifth hue, and a sixth hue; and an obtainer, configured for obtaining a preset adjustment coefficient, and obtaining a hue interval correction value according to the hue interval in which the first HSV spatial signal falls.

18. A display device comprising a driving system and a display panel driven by the driving system, the driving system comprising:

a receiver, configured for receiving a first color signal, converting the first color signal into first brightness normalized signals, and converting the first brightness normalized signals to obtain a first HSV (hue, saturation, value) spatial signal;

an adjuster, configured for obtaining a saturation signal of the first HSV spatial signal, increasing a saturation value of the saturation signal to obtain a second saturation signal and further obtain a second HSV spatial signal;

a calculator, configured for reducing a minimum value of the first brightness normalized signals according to the second HSV spatial signal to obtain second brightness normalized signals;

a converter, configured for converting the second brightness normalized signals to obtain a second color signal; and a driver, configured for driving the display panel using the second color signal;

wherein the operation of obtaining a saturation signal of the first HSV spatial signal, increasing a saturation value of the saturation signal to obtain a second saturation signal and further obtain a second HSV spatial signal comprises:

obtaining an adjustment coefficient according to a hue of the first HSV spatial signal; and adjusting the saturation value of the saturation signal s according to the adjustment coefficient to obtain the second saturation signal s';

wherein the adjustment coefficient satisfies the following formula:

$$s'=a\times s^4+b\times s^3+c\times s^2+d\times s+e;$$

where s denotes the saturation signal, s' denotes the second saturation signal, and a, b, c, d, e are constants.

19. The display device of claim 18, wherein the driving system of the display panel further comprises:

a divider, configured for dividing the first HSV spatial signal into six hue intervals depending on different hues, the six hue intervals comprising a first hue, a second hue, a third hue, a fourth hue, a fifth hue, and a sixth hue; and an obtainer, configured for obtaining a preset adjustment coefficient, and obtaining a hue interval correction value according to the hue interval in which the first HSV spatial signal falls.

* * * * *